US008851169B2

(12) United States Patent
Nikipelo

(10) Patent No.: US 8,851,169 B2
(45) Date of Patent: Oct. 7, 2014

(54) PROCESS AND APPARATUS FOR ENHANCING RECOVERY OF HYDROCARBONS FROM WELLS

(76) Inventor: Harold J. Nikipelo, Athabasca (CA)

( * ) Notice: Subject to any disclaimer, the term of this patent is extended or adjusted under 35 U.S.C. 154(b) by 335 days.

(21) Appl. No.: 13/394,122

(22) PCT Filed: Sep. 7, 2010

(86) PCT No.: PCT/CA2010/001354

§ 371 (c)(1),
(2), (4) Date: Mar. 2, 2012

(87) PCT Pub. No.: WO2011/026226

PCT Pub. Date: Mar. 10, 2011

(65) Prior Publication Data

US 2012/0160494 A1 Jun. 28, 2012

Related U.S. Application Data

(60) Provisional application No. 61/240,023, filed on Sep. 4, 2009.

(51) Int. Cl.

| | |
|---|---|
| ***E21B 36/00*** | (2006.01) |
| ***E21B 43/14*** | (2006.01) |
| ***E21B 43/16*** | (2006.01) |
| ***E21B 43/24*** | (2006.01) |

(52) U.S. Cl.

CPC ..... *E21B 43/24* (2013.01); *E21B 43/16* (2013.01)

USPC ..... 166/272.1; 166/303; 166/60

(58) Field of Classification Search

CPC ..... E21B 36/00; E21B 43/14

USPC ..... 166/272.1, 303, 57, 60

See application file for complete search history.

(56) References Cited

U.S. PATENT DOCUMENTS

| | | | | |
|---|---|---|---|---|
| 3,241,615 | A * | 3/1966 | Brandt et al. | 166/59 |
| 4,417,621 | A | 11/1983 | Medlin | |
| 4,807,701 | A | 2/1989 | Hall | |
| 4,957,164 | A | 9/1990 | Roark | |
| 5,052,482 | A * | 10/1991 | Gondouin | 166/50 |
| 6,241,019 | B1 | 6/2001 | Davidson | |
| 6,405,797 | B2 | 6/2002 | Davidson | |

(Continued)

FOREIGN PATENT DOCUMENTS

| | | | |
|---|---|---|---|
| CA | 2 232 948 | C | 9/1998 |
| CA | 2 502 800 | A1 | 9/2005 |
| CA | 2 621 855 | A1 | 9/2007 |
| WO | 2009/089622 | A1 | 7/2009 |

OTHER PUBLICATIONS

International Search Report mailed Feb. 2, 2011, issued in corresponding International Application No. PCT/CA2010/001354, filed Sep. 7, 2010, 2 pages.

(Continued)

*Primary Examiner* — William P Neuder

(74) *Attorney, Agent, or Firm* — Christensen O'Connor Johnson Kindness PLLC

(57) ABSTRACT

A method of enhancing recovery of hydrocarbons from a hydrocarbon formation, includes heating the hydrocarbon formation by injecting heated gas into a borehole; generating a series of pressure pulses in the borehole by flashing a liquid into a gas; and directing the pressure pulses into the hydrocarbon formation.

26 Claims, 5 Drawing Sheets

(56) References Cited

U.S. PATENT DOCUMENTS

| | | | | |
|---|---|---|---|---|
| 6,851,473 | B2 | 2/2005 | Davidson | |
| 7,644,759 | B2 | 1/2010 | Davidson | |
| 7,650,930 | B2 * | 1/2010 | Cheluget et al. | 165/95 |
| 2002/0144818 | A1 | 10/2002 | Leaute | |
| 2005/0189108 | A1 | 9/2005 | Davidson | |
| 2008/0302528 | A1 | 12/2008 | Samaroo | |

OTHER PUBLICATIONS

Zatka, M. "Shell Canada Energy—Unconventional Oil: In-situ Thermal Recovery." Queen's University Oil & Gas Conference, Ontario, Canada Jan. 24, 2009.

* cited by examiner

PROCESS AND APPARATUS FOR ENHANCING RECOVERY OF HYDROCARBONS FROM WELLS

FIELD

This relates to a process and apparatus for enhancing the recovery of hydrocarbons from subsurface formations, for example, enhancing the recovery of heavy oil from heavy oil reservoirs oil and recovery of bitumen from oil sands deposits.

BACKGROUND

In some wells, such as wells that produce heavy oil or bitumen, the production may be improved by using heat, such as steam-assisted gravity drainage (SAGD). Another process, such as described in U.S. Pat. No. 7,644,759 (Davidson) entitled "Enhancement of flow rates through porous media" use cold liquid to apply pulses to the downhole liquid in the surrounding matrix to increase the velocity of the liquids.

SUMMARY

According to an aspect, there is provided a method of enhancing recovery of hydrocarbons from a hydrocarbon formation, comprising the steps of: heating the hydrocarbon formation by injecting heated gas into a borehole; generating a series of pressure pulses in the borehole by flashing a liquid into a gas; and directing the pressure pulses into the hydrocarbon formation.

According to another aspect, the liquid may be flashed by a source of heat. The source of heat may be the heated gas. The liquid may impinge on a heat transfer surface that is heated by the heated gas. The source of heat may comprise a combustion heat source on surface connected to a conduit for transferring the heat downhole. The source of heat may comprise a downhole heat source, a surface heat source, or both.

According to another aspect, at least a portion of the heated gas may comprise combustion products or syngas.

According to another aspect, the liquid may comprises water, and may comprise a hydrogen-producing additive. The hydrogen-producing additive may be peroxide.

According to another aspect, the process injects heated gases downhole, which decreases the viscosity of the oil. The heated gases may be made up at least partially from the exhaust gases of the heating unit, such as a pulse jet unit fuelled by propane or natural gas. Exhaust gases are preferable as they contain carbon dioxide, which can be used to increase the API (America Petroleum Institute) gravity of the downhole hydrocarbons. As the formation is warmed by the heated gas, the viscosity of the hydrocarbons is reduced. By increasing the API gravity and reducing the viscosity, recovery of hydrocarbons can be enhanced. Preferably, a wet steam/water is injected downhole in a pulsing mode to enhance hydrocarbon recovery. Preferably, each segment of the process is controllable. For example, the pulsing mode is adjustable based on design and exhaust port length.

According to another aspect, there is provided an apparatus for enhancing recovery of hydrocarbons from a hydrocarbon formation, comprising a source of heated gas in communication with a borehole in the hydrocarbon formation, a downhole heating element in the borehole, and a source of liquid controlled by a valve that directs liquid onto the downhole heating element to generate a pressure pulse in the borehole by flashing the liquid into a gas. There is a sealing element in the borehole that retains the source of heated gas and the pressure pulse in the borehole.

According to another aspect, the apparatus may comprise a tubing string positioned in the borehole, and the sealing element may comprise a packer.

According to another aspect, the source of heated gas may comprise a combustion heater that is connected to a conduit in the borehole. The heated gas may comprise the combustion products of the combustion heater. The apparatus may further comprise a downhole heater for heating the heated gas.

According to another aspect, the downhole heating element may be a heat transfer surface. The heat transfer surface may be heated by the source of heated gas, or the heat transfer surface may be heated by a downhole heating element.

According to another aspect, the heated gas may comprise at least one of carbon dioxide, carbon monoxide, and hydrogen. The liquid may generate hydrogen when flashed. The liquid may comprise water, and the water may comprise a hydrogen producing additive, such as peroxide.

In one embodiment, the process may be referred to as a "Pulse Resonance Thermal Injected Syngas Process", or PRTISP. However, it will be understood that variations of this process may be used. For example, the frequency of pulses may not relate to the resonant frequency of the hydrocarbon formation in all circumstances, and other gases aside from syngas may be used.

The thermal temperature of the exhaust gases is preferably regulated to meet the engineering working specifications as set forth by given parameters and for maximum production. Prior to the exit point of the downhole pulsation tool, the gases may pass through a downhole heater that increases the temperature prior to being expelled through the downhole pulsation tool expulsion ports. Treated water/steam may be injected on the exhaust side to increase the absorption into the well reservoir as a heat transfer medium and to harness the steam expansion characteristics (high-temperature steam). This injection is preferably downhole at the exit point of the hot gas using a downhole pulsation tool.

The frequency of pulses generated by the pulse jet is preferably regulated based on both temperature and amplitude for the regulation of the wave's magnitude of oscillation. The goal is to cause penetration to within the reservoir and generate flow to the production well. With this process, the bottom water contact may be used as an energy transfer medium of the oscillation wave, preferably in a horizontal well for optimum production. Preferably, the sonic frequency is calculated to ensure that cap rock integrity is maintained by geomechanical methods and testing.

The use of propane or natural gas as a main fuel source along with a secondary fuel source and its by-products would be used as a solvent gaseous solution based on reservoir requirements. These may vary based on injection ratio, frequency cycle setting, etc., and the additional injection of makeup gas to meet production goals. Temperature may be regulated by above-ground activities and/or below-ground activities by use of the electronic heating element disposed within the tubular string.

According to another aspect, the injected fluids increase well productivity by upgrading heavy oil or bitumen in situ by making changes to the carbon chain, which will be achieved by thermal cracking. Catalytic cracking may also be involved through injection of a catalyst solution downhole using a downhole pulsation tool. The injection of water or steam may be used both as a transfer medium for heat and to assist in increasing the mobility of the oil or bitumen flowing to the production well by applying wet steam or water downhole in direct contact with high temperature gases, which will occur using a downhole pulsation tool. This will harness the steam expansion characteristics to pulsate movement of the oil by dilating natural subsurface formation fractures without causing damage to cap rock integrity. A toe-to-heel well configuration is preferably used to better preserve the in-situ upgrading, with vertical or horizontal injector wells and horizontal producer wells. This benefit has been demonstrated in prior art enhanced oil recovery processes and can be controlled to meet required operational parameters and benefits.

The process may be used in reservoir contexts including but not limited to the following:

- Reservoirs with high viscosity bitumen or heavy oil
- Reservoirs with mobile bottom water
- Reservoirs with difficult cap rock integrity issues
- Reservoirs with depths not over 1100 meters
- Reservoirs with narrow or restricted net pay over 6 meters
- Reservoirs with depletion drive mechanisms for heavy oil extraction
- Reservoirs for conventional oil production

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

Figure 1:
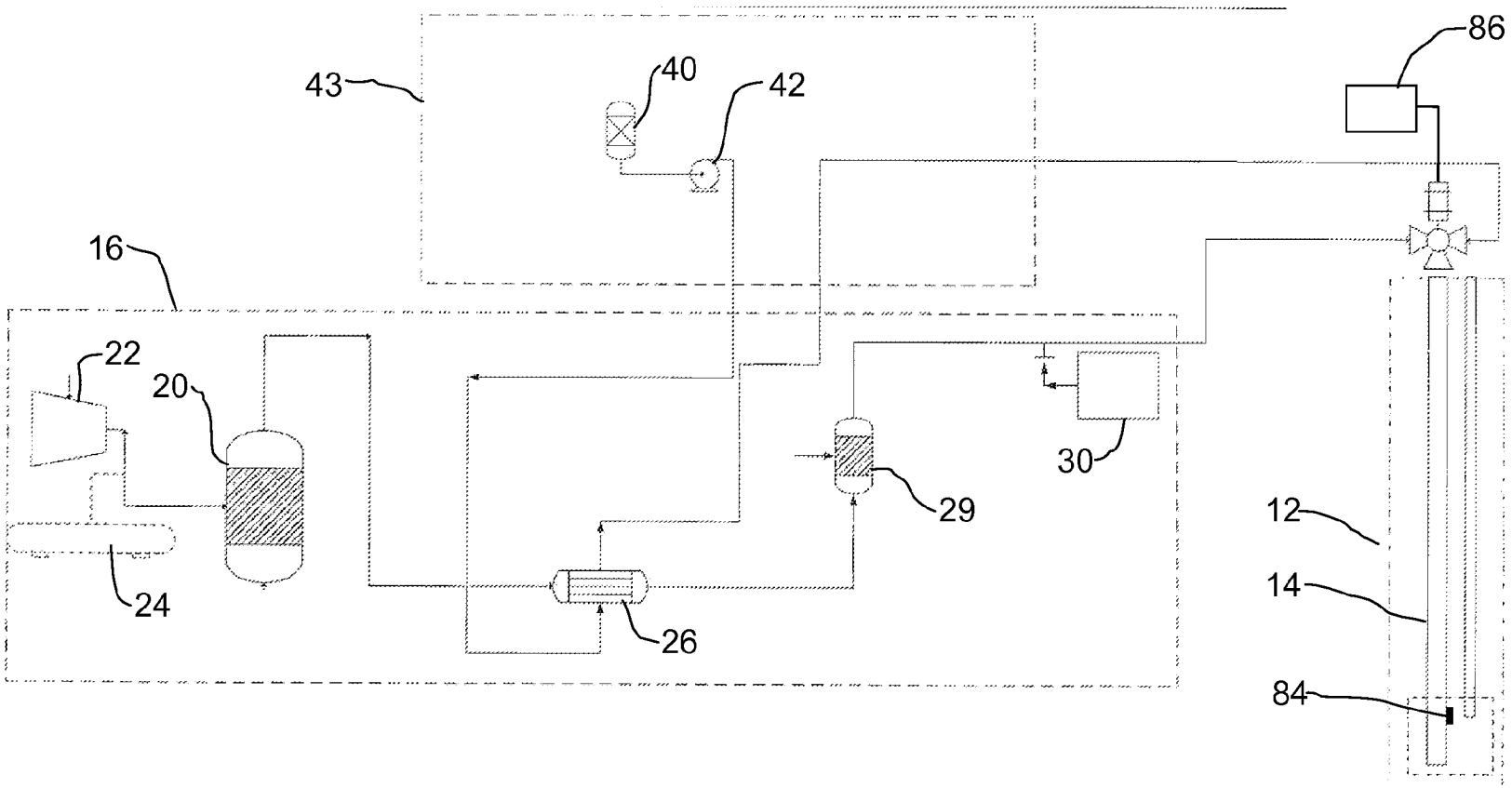
FIG. 1 is a schematic of the surface components of an apparatus for enhancing recovery of hydrocarbons.

Referring to FIG. 1, an example of how a process for enhancing recovery of hydrocarbons from a hydrocarbon formation 12 may be implemented is shown. The term "hydrocarbon formation" is used herein to describe a geological formation that contains liquid hydrocarbons. In particular, the process described herein is intended to be used to enhance the production from formations that contain heavy oil or bitumen, as it would not be required or not cost effective to use the process to enhance production of lighter forms of hydrocarbons. The process consists of continuous hot gas injection with an intermittent energy pulse.

As shown, a borehole 14 has been drilled into hydrocarbon formation 12. As will be described below, in the preferred embodiment this is not intended to be a producing borehole. Hydrocarbon formation 12 is heated by injecting heated gas into borehole 14. As this occurs, a series of pressure pulses are generated in borehole 14 by flashing a liquid into a gas such that the pressure pulses are directed the pressure pulses into hydrocarbon formation 12.

In the depicted embodiment, the heated gas is generated on a first skid 16, and is transferred into borehole 14. Preferably, the gases downhole will contain carbon monoxide and/or carbon dioxide such as may be present as a product of combustion, and hydrogen. Syngas, which is a gas mixture that contains carbon monoxide and hydrogen, and may also include carbon dioxide and other components, and may therefore be used in the process. Syngas may be generated by various methods, such as steam reforming of natural gas or liquid hydrocarbons to produce hydrogen, the gasification of coal, biomass, and in some types of waste-to-energy gasification facilities. The name comes from their use as intermediates in creating synthetic natural gas (SNG) and for producing ammonia or methanol. However, for the purposes of the presently described process, the syngas is not used as such. Instead, the mixture is used to heat the formation and reduce the viscosity of the hydrocarbons, and at least partially upgrade the hydrocarbons in formation 12. The hydrocarbons are upgraded by the heat and hydrogen, which result in thermal cracking, while the carbon monoxide and/or carbon dioxide increase the API gravity of the liquid hydrocarbons. As a result, the liquid hydrocarbons are more easily produced from the producing wells.

As depicted, the heated gas is produced using a heater 20 that burns, for example, propane or natural gas, or other hydrocarbons, and is fed the combustion air by a blower 22 and an optional supply of oxygen 24. Heater 20 may be similar to a jet engine. A secondary heater 29 that may be powered by, for example, acetylene, is used to increase the temperature and remove any oxygen via the combustion process before being injected into borehole 14. Additional syngas or other components may be injected from an additional source 30 prior to injection. As there may be some cooling, and to ensure that the desired temperature is achieved, a downhole heater 31 shown in FIG. 2, such as an electrical, catalytic, or combustion heater, may also be provided. Heater 31 would be controlled by a controller 86 shown in FIG. 1. The actual temperature will depend on the formation and the hydrocarbons being produced. However, for a target downhole temperature of 300 to 340° C., the surface temperature may be in the range of 500 to 570° C. The drop is due primarily to the energy required to flash water into steam. In the process described herein, combustion product are injected downhole, as the hydrogen component is produced from the water system, as will be described below. Alternatively, a carbon dioxide/monoxide and hydrogen mixture, such as syngas, may be generated and pumped downhole directly after being heated. It will be understood that the actual composition of the heated gas may vary depending on the hydrocarbon formation, and the preferences of the user.

Figure 2:
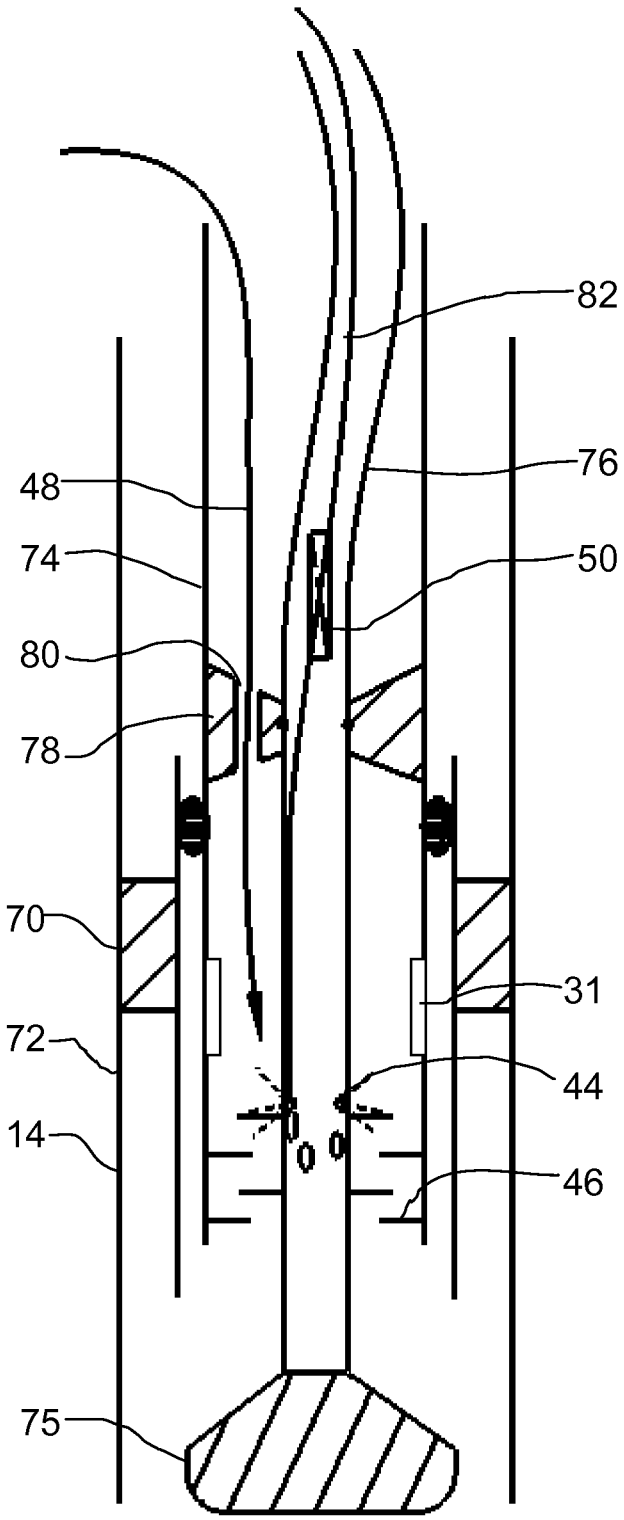
FIG. 2 is a side elevation view in section of the downhole components of the apparatus for enhancing recovery of hydrocarbons.

In addition to the heated gas, pressure pulses are also applied to formation 12. Preferably, these are produced by flashing water downhole to generate steam pressure. Referring to FIG. 1, water is pumped from a water supply 40 by pump 42 carried on a second skid 43 into borehole 14 after being preheated by heat exchanger 26. Referring to FIG. 2, water is converted into steam downhole as it comes into contact with a heat source. As depicted, water is ejected from nozzles 44 or ports in coil tubing 76 against a heat transfer surface, which, as depicted is a set of baffles 46. Baffles 46 are preferably heated by the flow of heated gas 48. The water may also be partially or fully converted into steam as it comes into contact with heated gas 48. It will be understood that different designs may be used to cause water to flash. For example, the heat transfer surface may take various forms to optimize the process aside from baffles 46. Alternatively, baffles 46 may be heated by other sources aside from heated gas 48, such as a downhole heat source. As downhole steam generators are known in the art, other designs may also be used. However, any steam generator design must be capable of flashing the water. In this context, "flashing" means converting sufficient amounts of water into steam at a rate sufficient to generate a pressure pulse. As water is converted into steam, the volume expands greatly. If this is done at a fast enough rate, the downhole area can be filled and a pressure pulse can be generated into the formation. Preferably, the pressure increase is sufficiently rapid and to a sufficient magnitude that may simulate p-wave in the formation. To achieve the required pressure pulse, the steam must be generated within a very short period of time. Accordingly, it is preferably to generate the steam downhole. In addition to generating steam, flashing water may also be used to generate hydrogen, which is used in thermally cracking the hydrocarbons. Accordingly, the water injected downhole preferably contains an additive, such as peroxide, that helps produce hydrogen.

The injection of water or steam will be used as both a transfer medium for heat and assist in increasing the mobility of the bitumen flowing to the production well by applying wet steam or water downhole in direct contact with high temperature gaseous. The steam expansion characteristics pulsates movement of the oil by dilating the natural fractures without causing damage to cap rock integrity. In addition, the pressure increase will affect the surface tension of the liquid hydrocarbons and therefore encourage the liquid hydrocarbons to release from the hydrocarbon formation. In order to better preserve the in-situ upgrading, a toe to heal configuration is preferably used, with vertical or horizontal injectors and horizontal producers, as will be discussed in more detail below. The upgrading is preserved by the short-distance oil displacement.

The pressure pulses may be applied at regular or irregular intervals, continuously or in groups. The frequency of the pressure pulses may be controlled by a valve 50. The timing and duration of the opening of valve 50 controls the frequency and magnitude of the pressure pulse. The heat required to maintain the process can be determined based on the frequency and magnitude of the pressure pulse, or in other words, the volume of the water to be flashed, and the temperature differential between the temperature of the water and the target temperature of the steam.

In some circumstances, it may be beneficial to generate pulses at the resonant frequency of hydrocarbon formation 12. This results in more penetration into the reservoir and increases flow to the production well. Resonance occurs when the frequency of induced bottomhole pulses matches the natural oscillatory frequency of the reservoir state, and allows the maximum amplitude of pulses in the reservoir to be generated. Propagation of pressure wave is proportional to hydraulic diffusivity. Permeability, porosity, total compressibility and oil viscosity are important parameters for how far the pulse will propagate. At the resonant frequency, pulse penetration is augmented into reservoir and enhances short distance mobilization of fluids. Maximum amplitude of pulses takes geomechanical cap rock integrity into consideration to avoid damaging the rockcap, which may occur at its resonant frequency. Preferably, the frequency should be calculated to ensure cap rock integrity is maintained by geomechanical methods and testing. It is anticipated that a regular patter of pressure pulses will be applied at a frequency of around one per second or less, for example, between 0.1-1 Hz. However the actual frequency may be higher or lower than this range, depending on the characteristics of the formation.

p-wave similar to earthquake—dramatic shock massive change in pressure

Figure 5:
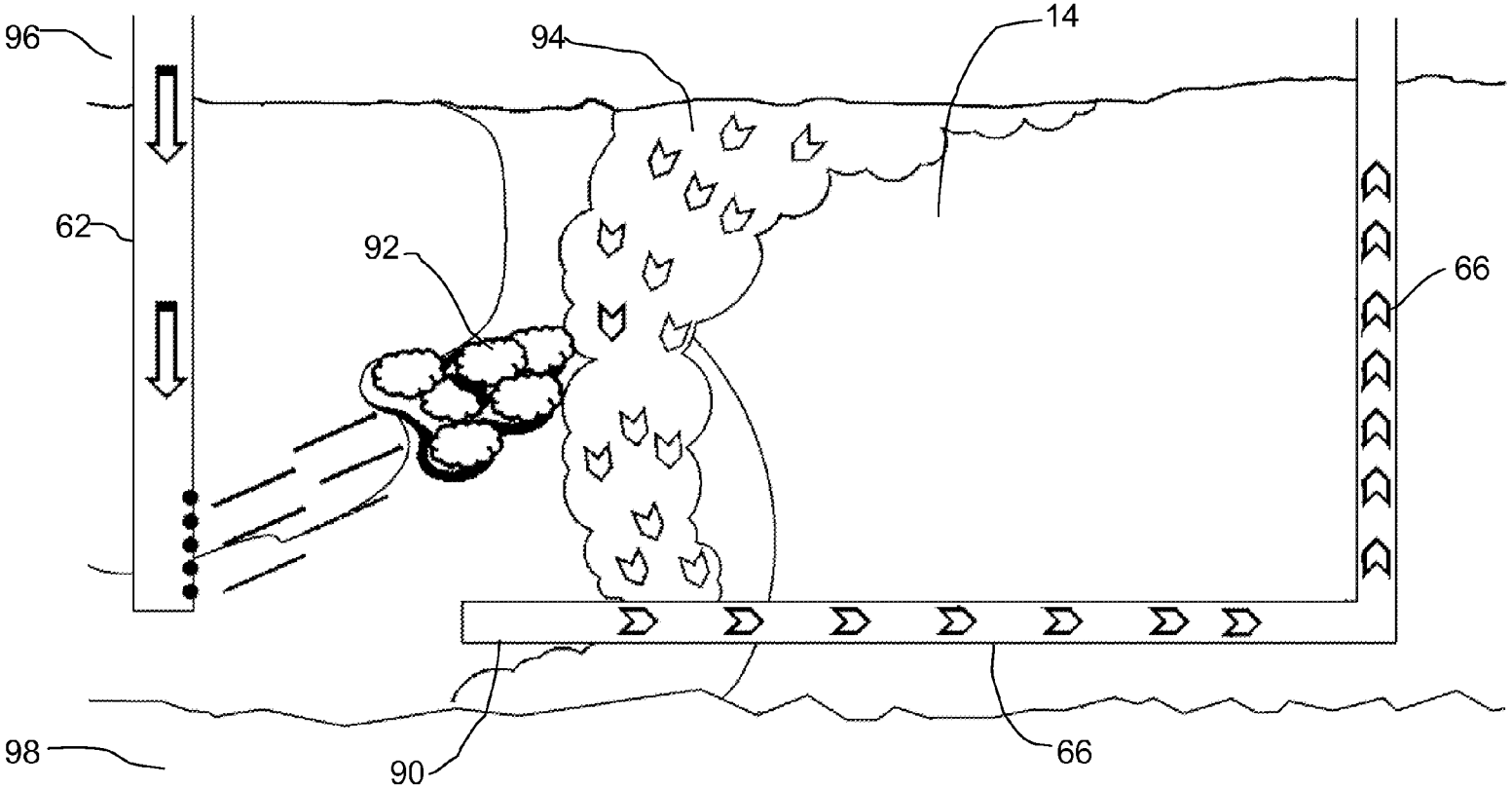
FIG. 5 is an illustration of the process for enhancing recovery of hydrocarbons.

The pressure pulses should assist the production of fluid, but should not exceed the fracture pressure of the formation. Other factors that determine the pressure include the reservoir pressure, the reservoir injection pressure, the overburden pressure, and the underburden pressure. The pressure of pulse decreases as the steam cools and dissipates through formation 12. The rate of decrease will depend on the formation, and is one factor taken into consideration in determining the frequency of the pulses. The baseline pressure, or the pressure between pulses, is preferably defined primarily by the pressure of the heated gas, which must be greater than the wellbore pressure to ensure heated gas continues to enter borehole 14. Preferably, this is as low as possible. Referring to FIG. 5, this reduces the pressure pulses and exhaust gases from creating a conduit through the formation, such as through bottom water in underburden 98. Instead, bottom water 54 can be used as an energy transfer medium of the pressure pulses.

Figure 3:
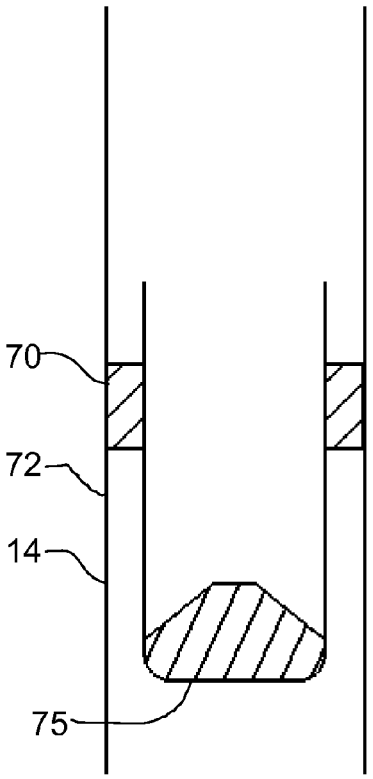
FIG. 3 is a side elevation view in section of a thermal packer.
Figure 4:
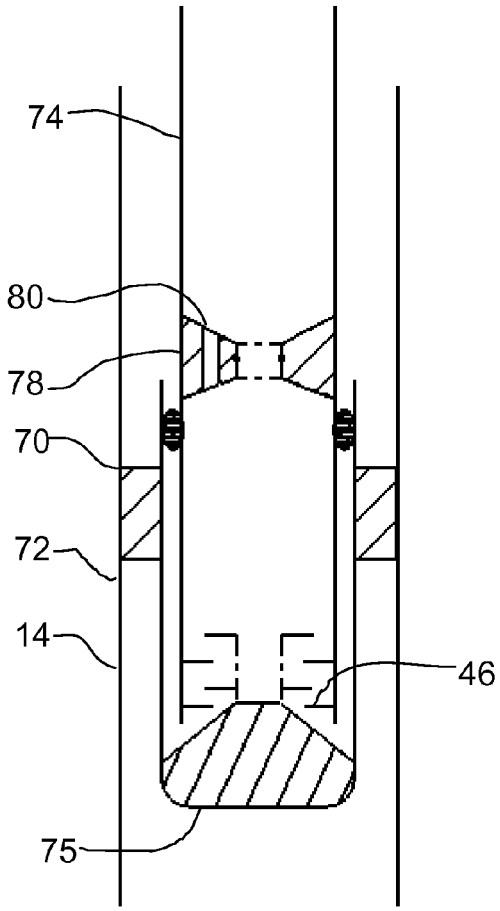
FIG. 4 is a side elevation view in section of a tubing string installed in the thermal packer.

Referring to FIG. 3, an embodiment of the apparatus is installed downhole by positioning a thermal packer 70 against the casing 72. Referring to FIG. 4, a tubing string 74 is then inserted into in thermal packer 70. As shown, thermal packer 70 has a plug 75 that is closed at this point. Referring to FIG. 2, coil tubing 76 is then inserted into tubing string 74 through a seal 78 with a port 80 for the heated gases to pass through, which opens plug 75, and allows the passage of heated gas 48. Coil tubing 76 may be used to house the instrumentation lines, the water line 82, and other supply lines. Alternatively, water line 82 may be outside of coil tubing 76, and pass through a port in seal 78. The additional downhole heating element may be part of a tubing string around coil tubing 76 (not shown). Referring to FIG. 1, the instrumentation lines may connect to temperature and pressure sensors 84, and may also provide control signals to valve 50. The sensor readings are received by, and control signals generated by a controller 86 that is preferably located on surface, as shown in FIG. 1. It will be understood that the description above is one example of a downhole tool that may be used to inject the heated gas while generating pressure pulses downhole, and that modifications or other designs or may be made by those skilled in the art.

Referring to FIG. 5, the process is preferably used in a toe-to-heel configuration, where the stimulation is applied by an injector well 62 toward the toe 90 of the horizontal leg 66 for a producer well 60. The heated gas, steam and pressure pulses are represented by clouds 92, and are applied as discussed above. The process causes hydrocarbons in area 94 to flow more readily into horizontal leg 66 where they are pumped to surface. As shown, the process is applied below the overburden 96 and above the underburden 98. Care must be taken not to damage the overburden 96. In addition, the pressure is regulated to avoid any seal problems with the cap rock in which the pressurized gas escapes from hydrocarbon formation 12, and also to avoid creating a channel into the bottom water in or on underburden 98, which results in a higher flow of water being produced rather than hydrocarbons.

Figure 6:
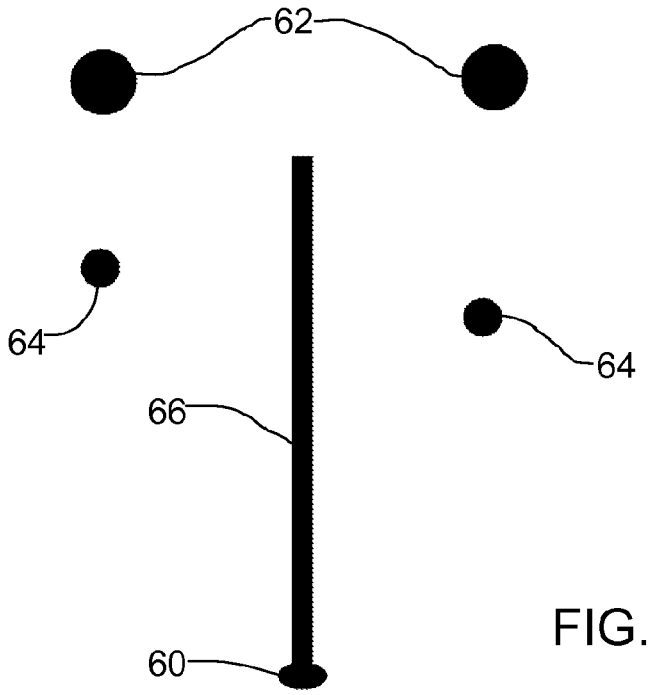
FIG. 6 is a schematic of a wellsite with five boreholes, including one producing well.
Figure 7:
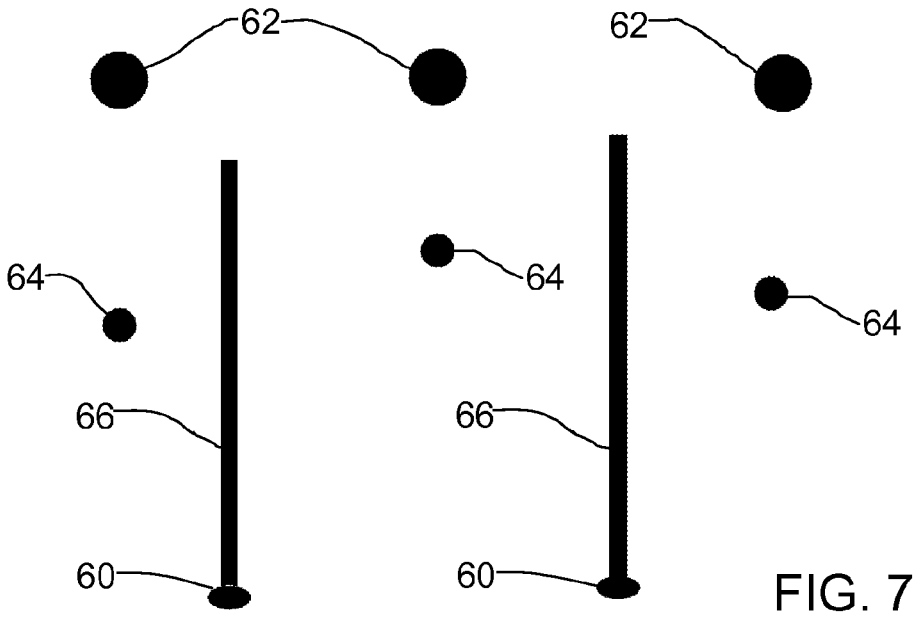
FIG. 7 is a schematic of a wellsite with seven boreholes, including two producing wells.

Referring to FIG. 6, the process may be used in an arrangement with five wells—i.e., a horizontal producer well 60, two injector wells 62, and two observation wells 64. The horizontal producer 60 would be cored prior to drilling out the horizontal leg 66 of the well. The purpose is to ensure proper placement of the leg in the bottom of the pay zone and ensure the utilization of the natural fracturing during production. The injectors 62 would be perforated in the upper portion of the pay zone. All wells would be developed using thermal application guidelines and equipped with downhole monitoring equipment (not shown) to assist in evaluating reservoir performance and stability. While the five-well example is described herein, other well arrangements may also be used. For example, referring to FIG. 7, another toe-to-heel arrangement is shown with two producer wells 60, three injector wells 62, and three observation wells.

Referring to FIG. 6, the two injector wells 62 would be located within an area calculated to ensure that communication between the two wells is achievable. One injector well 62 would be offset in both distance and angle to provide enhanced optimum delivery features based on reservoir testing requirements. These would be predetermined by reservoir modelling. The two observation wells 64 would be developed using thermal application guidelines, as well. The injector well facilities would be engineered to meet with regulatory approval using approved engineered specifications. Regulating guidelines would be developed during the HAZOPS phase of the engineering and be incorporated into the process. Practical benefits and advantages that may be realized include but are not limited to the following:

1. Higher oil recovery due to the effective attenuation of the negative effect of heterogeneity due to both, use of the toe-to-heel configuration and of the pulsing injection technology.
2. In-situ upgrading due to the high temperature realized in combination with the effect of hydrogen, when the syngas contains hydrogen.
3. More possibilities of process control not only by adjusting the total injection rate and the composition of the injection steam but also by adjusting the "pulsing wave" parameters in conjunction with oil production performance.
4. A significant reduction in fuel gas consumption for steam generation and efficient utilization of any by-product emission to be re-introduced into the process.
5. Significant improved project economics as Pulse Resonance Thermal Injected Syngas Process (PRTISP) recoveries are estimated to be as much as 65% greater than other known technologies and both capital and operational costs are estimated to be considerably lower than comparable projects of this nature.
6. Massive reduction in water usage due to harnessing both characteristics including thermal medium transfer and steam expansion to optimum production through evaluating downhole performance, modifying or making the required adjustments to increase production without stopping operations.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The following claims are to be understood to include what is specifically illustrated and described above, what is conceptually equivalent, and what can be obviously substituted. Those skilled in the art will appreciate that various adaptations and modifications of the described embodiments can be configured without departing from the scope of the claims. The illustrated embodiments have been set forth only as examples and should not be taken as limiting the invention. It is to be understood that, within the scope of the following claims, the invention may be practiced other than as specifically illustrated and described.

What is claimed is:

1. A method of enhancing recovery of hydrocarbons from a hydrocarbon formation, comprising the steps of:

heating the hydrocarbon formation by injecting heated gas into a borehole;

generating a series of pressure pulses in the borehole by flashing a liquid into a gas; and directing the pressure pulses into the hydrocarbon formation.

2. The method of claim 1, wherein the liquid is flashed by a source of heat.

3. The method of claim 2, wherein the source of heat is the heated gas.

4. The method of claim 3, wherein the liquid impinges on a heat transfer surface that is heated by the heated gas.

5. The method of claim 2, wherein the source of heat comprises a combustion heat source on surface connected to a conduit for transferring the heat downhole.

6. The method of claim 2, wherein the source of heat comprises a downhole heat source.

7. The method of claim 1, wherein at least a portion of the heated gas comprises combustion products.

8. The method of claim 1, wherein at least a portion of the heated gas comprises syngas.

9. The method of claim 1, wherein at least a portion of the gas comprises hydrogen.

10. The method of claim 1, wherein the liquid comprises water.

11. The method of claim 1, wherein flashing the liquid produces hydrogen.

12. The method of claim 11, wherein the liquid comprises water and a hydrogen-producing additive.

13. The method of claim 12, wherein the hydrogen-producing additive is peroxide.

14. An apparatus for enhancing recovery of hydrocarbons from a hydrocarbon formation, comprising:

a source of heated gas in communication with a borehole in the hydrocarbon formation;

a downhole heating element in the borehole;

a source of liquid controlled by a valve that directs liquid onto the downhole heating element to generate a pressure pulse in the borehole by flashing the liquid into a gas;

a sealing element in the borehole that retains the source of heated gas and the pressure pulse in the borehole.

15. The apparatus of claim 14, further comprising a tubing string positioned in the borehole, the sealing element comprising a packer.

16. The apparatus of claim 14, wherein the source of heated gas comprises a combustion heater that is connected to a conduit in the borehole.

17. The apparatus of claim 16, wherein the heated gas comprises the combustion products of the combustion heater.

18. The apparatus of claim 16, further comprising a downhole heater for heating the heated gas.

19. The apparatus of claim 14, wherein the downhole heating element is a heat transfer surface.

20. The apparatus of claim 19, wherein the heat transfer surface is heated by the source of heated gas.

21. The apparatus of claim 19, wherein the heat transfer surface is heated by one of an electrical heater, a catalytic heater, or a combustion heater.

22. The apparatus of claim 14, wherein the heated gas comprises at least one of carbon dioxide, carbon monoxide, and hydrogen.

23. The apparatus of claim 14, wherein the liquid comprises water.

24. The apparatus of claim 23, wherein the water comprises a hydrogen producing additive.

25. The apparatus of claim 23, wherein the hydrogen producing additive is peroxide.

26. The apparatus of claim 14, wherein the liquid generates hydrogen when flashed.

* * * * *